US005473961A

United States Patent [19]

Jackson et al.

[11] Patent Number: 5,473,961

[45] Date of Patent: Dec. 12, 1995

[54] CONTROL APPARATUS

[75] Inventors: Mark A. Jackson, Fresno; Michael M. Farrell, Kingsburg, both of Calif.

[73] Assignee: Pepco Water Conservation Products, Fresno, Calif.

[21] Appl. No.: 145,693

[22] Filed: Oct. 29, 1993

[51] Int. Cl.[6] ..... G05G 5/04; B05B 3/16; G09F 11/04

[52] U.S. Cl. ..... 74/526; 116/307

[58] Field of Search ..... 74/526; 116/307, 116/311, 312, 315, 320; 239/71, 242

[56] References Cited

U.S. PATENT DOCUMENTS

| | | | |
|---|---|---|---|
| 201,637 | 3/1878 | Treat | 116/298 |
| 1,468,235 | 9/1923 | Japy | 116/315 |
| 2,398,015 | 4/1946 | Leathers | 161/15 |
| 2,429,313 | 10/1947 | Gilbert | 74/526 X |
| 2,527,095 | 10/1950 | Hare | 116/129 |
| 2,637,987 | 5/1953 | Hill et al. | 64/29 |
| 2,767,681 | 10/1956 | Pontius | 116/125 |
| 3,301,362 | 1/1967 | Helland | 192/56 |
| 4,317,253 | 3/1982 | Gut et al. | 15/390 |
| 4,892,252 | 1/1990 | Bruninga | 239/205 |
| 5,174,501 | 12/1992 | Hadar | 239/242 X |

*Primary Examiner*—Allan D. Herrmann
*Attorney, Agent, or Firm*—Worrel & Worrel

[57] ABSTRACT

A control apparatus for a work object, the control apparatus having a pair of substantially contrarotating members operable to define a selected relationship designated by the relationship of the members relative to each other; and an assembly for mounting the substantially contrarotating members in controlling relation to the work object whereby the selected relationship is operable to control the work object.

13 Claims, 5 Drawing Sheets

CONTROL APPARATUS

BACKGROUND OF THE INVENTION

1. Field of the Invention

The present invention relates to a control apparatus and, more particularly, to such a control apparatus which is operable to control the path of movement of a work object and which displays the path to be followed by the work object for convenient reference.

2. Description of the Prior Art

It is frequently necessary in the operation of such work objects as security cameras, movable lights, sensing devices, sprinklers and the like to control the path of movement of the work object during operation. For example, in all of the foregoing instances, the work objects are moved during operation along a path which, for reasons individual thereto, must be controlled. In these exemplary cases, the work objects are individually moved in reciprocal motion along arcuate paths which may be all, or any divisible sector, of a three hundred and sixty degree (360°) path of travel about an axis of rotation. A variety of devices are conventionally employed for controlling the range of movement of the work object within such a path of movement.

For example, in the case of sprinklers, it is known to employ control mechanisms which allow the adjustment of the sector of movement of a reciprocating sprinkler. Illustrative of one such control mechanism is that disclosed in the Bruninga U.S. Pat. No. 4,892,252. The patent discloses a pattern control assembly which cooperates with a lever and a resilient post reversing mechanism in the control of the path of fluid released from the sprinkler. Thus, the sprinkler is adjustable to control the sector of a three hundred and sixty degree (360°) circle within which the sprinkler reciprocates to release irrigation water. Adjustment members are employed to define the sector of the circle within which the sprinkler reciprocates and the adjustment members are positionable relative to each other to define the sector so selected.

Prior art control devices for sprinklers and other such work objects, while operable within limited abilities to perform certain operational objectives, are otherwise ill suited to the performance of their stated tasks. The devices are notoriously complex, temperamental, expensive, difficult to operate and chronically subject to malfunction as a result of tampering or inadvertent misadjustment. Because of the expense involved, such devices for sprinklers typically are employed in commercial applications such as golf courses, parks, business and industrial complexes, and other public facilities where the devices are employed in large numbers. They are, as a consequence, exposed to damage or tampering by passersby. In such installations, the need for adjustment thereof requires that access be provided to the adjustment mechanism. However, such access renders the devices chronically subject to tampering by passersby who may intentionally misadjust the mechanism. In other instances, the devices are exposed to impact by lawn mowers, foot traffic and the like which may cause inadvertent misadjustment of the control mechanisms. In still other instances, the requirement that such devices at the time of installation and thereafter be adjusted by untrained or only partially trained personnel further increases the likelihood that they are misadjusted during their useful lives. Still further, the complexity of such prior art devices renders them sensitive to malfunction as a result of damage due to impact.

There are still other inherent disabilities in prior art devices designed for the same purpose which render them less than satisfactory in the performance of their operational objectives. In those few prior art devices which have any means for readily indicating the sector to which such adjustment has been made, the indicating mechanism itself is, to varying degrees, inaccurate, misleading and, at best, only remotely indicative of the actual sector to which the mechanism has been adjusted. Furthermore, such prior art indicating mechanisms are typically obscure and require a certain minimum level of understanding before the information intended to be imparted thereby is understood. Since, as previously noted, the adjustment of such devices is characteristically performed by persons having little or no training, the frequency with which unintended misadjustment occurs is significantly higher than would otherwise be deemed to be acceptable.

As also previously noted, the very complexity of such prior art devices ensures that the cost thereof is significantly beyond the range within which small businesses, homeowners and other entities of limited means could afford to employ such devices. There has not, heretofore, been such a prior art device which was available at a cost suited to such small operators.

Still further, such prior art devices are not suited to universal application in that they inherently must be employed only in the specific areas of application for which they were specifically designed. There has not heretofore been a device adapted for the same broad purpose which was capable of virtually universal application in the control of work objects of a wide variety of types and areas of application.

Therefore, it has long been known that it would be desirable to have a control apparatus adapted to control the path of movement of a work object which is capable of controlling the path of movement of the work object over a long operational life; which minimizes the risk of misadjustment as a result of tampering or inadvertent missetting thereof; which affords an immediately recognizable and precise display of the range of movement to which it has been set so as to avoid inadvertent misadjustment; which possesses a simplicity of structure and operation ensuring a long operational life and a minimum purchase price; and which otherwise is entirely effective in achieving its operational objectives.

SUMMARY OF THE INVENTION

Therefore, it is an object of the present invention to provide an improved control apparatus.

Another object is to provide such a control apparatus which is operable to control such work objects as security cameras, movable lights, sensing devices, sprinklers and the like in movement through proscribed paths of travel.

Another object is to provide such a control apparatus which is particularly well suited to the control of movement of a work object which is moved in reciprocal motion within an arcuate path of travel.

Another object is to provide such a control apparatus which possesses a universality of application such that, with little or no modification, it can be employed in a variety of types of work objects in a variety of operating environments to perform its operational objectives.

Another object is to provide such a control apparatus which possesses the ability substantially to minimize the risk of misadjustment due to tampering, inadvertent contact and other causes once installed.

Another object is to provide such a control apparatus which precisely displays, in a readily recognizable manner, the adjustment to which the control apparatus has been set and similarly conveys, even to personnel with little or no training, the means by which to adjust the control apparatus to the setting.

Another object is to provide such a control apparatus which is of a very small size so as to be usable in work objects of virtually any type while, at the same time, being fully visible in displaying the information imparted thereby.

Another object is to provide such a control apparatus which is particularly well suited to usage in sprinklers of the reciprocating type wherein the sprinkler nozzle is rotated through an arcuate path of up to three hundred and sixty degrees (360°) and is adjustable to limit the path to substantially any size sector thereof.

Another object is to provide such a control apparatus which can be manufactured at minimal expense so as to be usable in even work objects of the smallest overall price.

Another object is to provide such a control apparatus which can be manufactured in a form which is sealed so as to minimize damage as a result of tampering while being fully adjustable by authorized personnel.

A further object is to provide such a control apparatus which possesses a safety mechanism which prevents damage by releasing when undue force is applied thereto, but which maintains the setting thereof precisely as desired so that it remains fully operational when returned to an initial starting position.

A still further object is to provide such a control apparatus which can be employed in work objects of a variety of types with little or no design modification of the work objects.

Further objects and advantages are to provide improved elements and arrangements thereof in an apparatus for the purpose described which is dependable, economical, durable and fully effective in accomplishing its intended purpose.

These and other objects and advantages of the control apparatus of the present invention are achieved, in the preferred embodiment, by a pair of substantially contrarotating members operable to define a selected relationship; and a mechanism for mounting the substantially contrarotating members in controlling relation to the work object whereby the selected relationship is operable to control the work object.

DESCRIPTION OF THE PREFERRED EMBODIMENT

Figure 1:
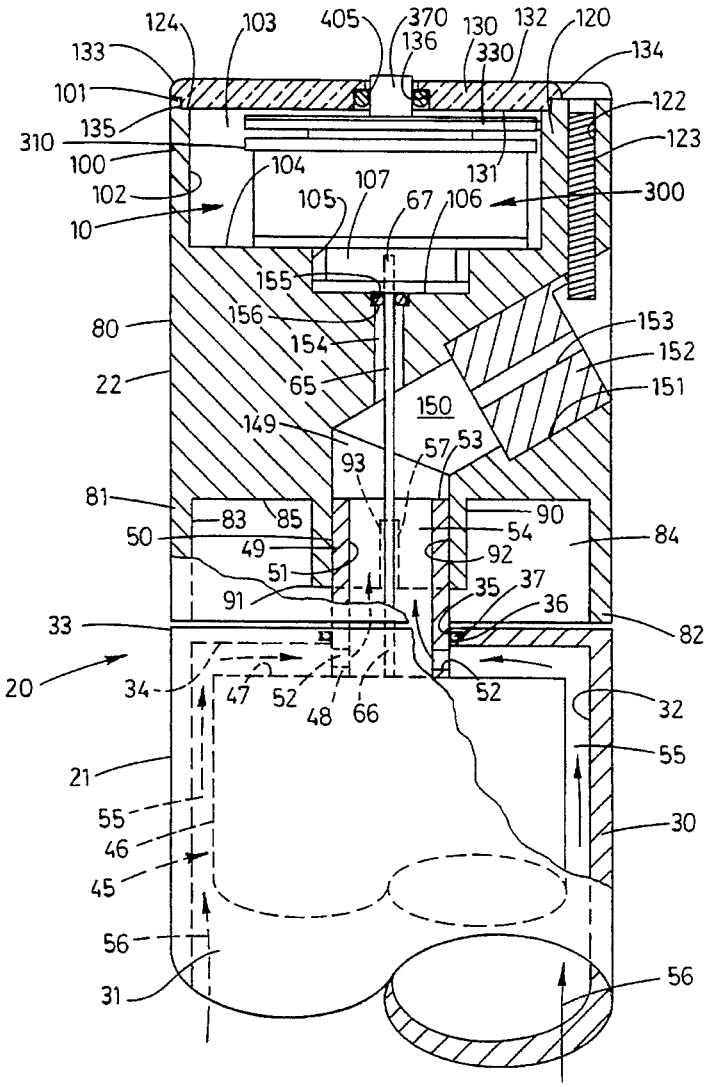
FIG. 1 is a fragmentary vertical section of a work object, in this case a reciprocating sprinkler, mounting the control apparatus of the present invention in controlling relation thereto.

Referring more particularly to the drawings, the control apparatus of the present invention is generally indicated by the numeral 10 in FIG. 1. The control apparatus is adapted for usage in a wide variety of work objects including such work objects as security cameras, movable lights, sensing devices and a host of other types of work objects.

In the illustrative environment shown in the drawings and described herein, the work object is a sprinkler 20 of the reciprocating type; that is, a sprinkler which operates automatically to move the nozzle thereof through an arcuate path of travel in a range of up to three hundred and sixty degrees (360°) in reciprocating motion and about a vertical axis of rotation. For example, a sprinkler of this general type is disclosed in the Bruninga U.S. Pat. No. 4,892,252. The prior art is replete with sprinklers of this general type and the control apparatus of the present invention is not limited in any respect to any particular type of sprinkler or to any particular type of work object. As shown in FIG. 1, the sprinkler 20 has a lower portion, or drive housing, 21 and an upper portion, or control housing, 22.

In the illustrative environment, the drive housing 21 of the sprinkler 20 has a cylindrical wall 30, which is typically, constructed of a suitable plastic material. The cylindrical wall has a cylindrical exterior surface 31 and a cylindrical interior surface 32. The cylindrical wall has a circular upper edge 33 across which extends a flat top wall 34 in sealing relation thereto. A central passage 35 extends through the top wall concentric to the cylindrical wall and is bounded by an annulus 36. A fluid seal, or O-ring, 37 is mounted on the annulus.

A drive mechanism 45 is mounted within the drive housing 21. The drive mechanism has a cylindrical exterior surface 46 and an upper surface 47 right-angularly related to the exterior surface. The drive mechanism can be of any suitable type and does not constitute part of the present invention. The Bruninga U.S. Pat. No. 4,892,252 discloses one such drive mechanism, but a variety of other conventional drive mechanisms can be employed. The drive mechanism is, however, in this illustrative environment, operable to rotate the structure hereinafter to be identified in reciprocal motion through an arcuate path of travel up to three hundred and sixty degrees (360°) and is capable of being controlled for operation in such reciprocal motion through any segment of the arcuate path of travel between three hundred and sixty degrees (360°) and a predefined minimum, such as about two degrees (2°).

A drive sleeve 48 is mounted on and extends axially from the upper surface 47 of the drive mechanism 45 concentric to the cylindrical wall 30 of the drive housing 21. The drive sleeve has a cylindrical wall 49 having a cylindrical exterior surface 50 and a cylindrical interior surface 51. The drive sleeve is preferably constructed of a suitably strong plastic material. The drive sleeve has two or more fluid ports 52 extending therethrough immediately above the upper surface 47 of the drive mechanism 45. The drive sleeve has an annular upper edge 53. A fluid passage 54 extends through the drive sleeve and outwardly through the upper edge 53. The drive housing has a fluid passage 55 extending about the drive mechanism 45, as shown in FIG. 1, through the fluid ports 52 of the drive sleeve and into communication with the fluid passage 54 of the drive sleeve. Arrows 56 in FIG. 1 illustrate the path of fluid flow from a source of water under pressure, not shown. A pair of laterally extending ribs 57 extend from the exterior surface 50 of the cylindrical wall 49 in opposite directions longitudinally aligned with the cylindrical wall and on opposite sides thereof.

Figure 6:
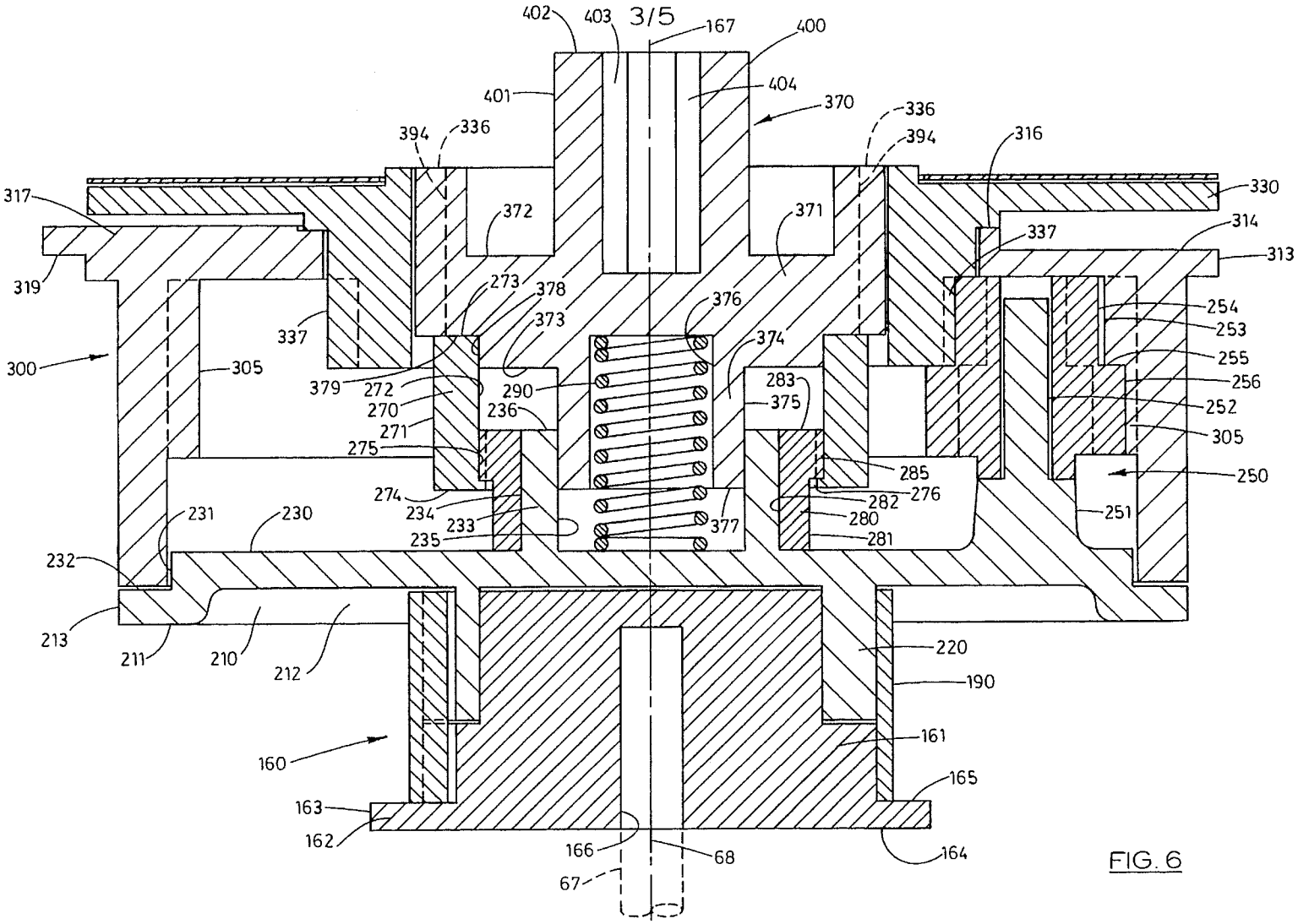
FIG. 6 is a somewhat enlarged vertical section taken on line 6-6 in FIG. 3.

The drive mechanism 45 is controlled by a control shaft 65, preferably constructed of metal, having a lower portion 66 operably connected to the drive mechanism and extending to an upper portion 67 extending through the drive sleeve 48 and a predetermined distance above the upper edge 53 thereof. As shown in FIG. 6, the control shaft defines an axis of rotation 68 extending longitudinally thereof and also constituting the longitudinal axis of the drive mechanism 45.

The control housing 22 of the sprinkler 20 has an outer cylindrical surface 80 concentric to the axis of rotation 68 of the control shaft 65. The control housing is also preferably constructed of a suitable, strong plastic material. The control housing has a lower cylindrical wall 81 extending downwardly therefrom to a lower annulus 82 concentric to the axis of rotation 68 and spaced slightly from the upper edge 33 of the cylindrical wall 30 of the drive housing 21. The lower cylindrical wall has an inner cylindrical surface 83 bounding a lower chamber 84. The lower chamber is bounded at its interior extremity by a flat interior surface 85.

A connection sleeve 90 is mounted on the interior surface 85 extending therefrom concentric to the axis of rotation 68 to an annulus 91. The connection sleeve has a cylindrical interior surface 92. A pair of slots 93 are formed in the connection sleeve on opposite sides thereof and oriented and dimensioned so as slidably to receive the ribs 57 of the drive sleeve 48 thereby mounting the control housing on the drive housing in the manner shown in FIG. 1 for rotation about the axis of rotation 68.

The control housing 22 has an upper cylindrical wall 100 extending to an upper annulus 101. The upper cylindrical wall has an inner cylindrical surface 102, except as hereinafter noted, concentric to the axis of rotation 68. The inner cylindrical surface bounds an upper chamber 103. An interior surface 104 at the lower end of the upper chamber is right-angularly related to the axis of rotation 68. Concentric to the axis of rotation, a cylindrical surface 105 extends inwardly from the interior surface 104 and terminates in an interior surface 106 right-angularly related to the axis of rotation. The cylindrical surface 105 and interior surface 106 define a lower chamber 107 beneath the upper chamber 103. The upper portion 67 of the control shaft 65 extends inwardly of the lower chamber 107, as shown in FIG. 1.

Figure 3:
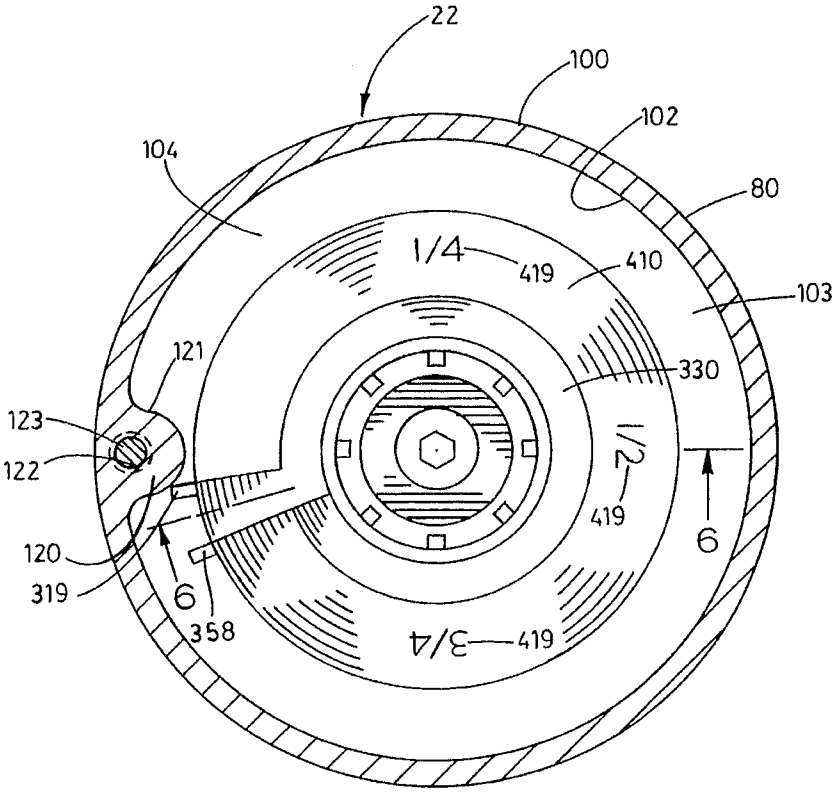
FIG. 3 is a transverse section of the control housing of the sprinkler shown in FIG. 1 mounting the control apparatus of the present invention therewithin.

As shown best in FIGS. 1 and 3, the control housing 22 mounts a protrusion 120 having a rounded surface 121 extending into the upper chamber 103 of the control housing and constituting the only portion of the inner cylindrical surface 102 which is not, in fact, cylindrical or concentric to the axis of rotation 68. If desired, the protrusion can simply provide a narrow vertical ridge or rib so as, to that extent, increase the range slightly. A screw threaded bore 122 extends through the protrusion along a path parallel to the axis of rotation 68. An adjustment screw 123 is screw-threadably received in the screw threaded bore. The protrusion is preferably, although not necessarily, cast as part of the molded plastic control housing. The upper annulus 101 of the upper cylindrical wall 100 of the control housing has a countersunk surface 124 extending thereabout concentric to the axis of rotation 68 with the exception of the portion extending through the protrusion 120. This portion of the countersunk surface extends about the protrusion between the screw threaded bore 122 and the rounded surface 121 of the protrusion and conforms thereto.

A transparent plastic cover plate 130 is, as preferred, either snap fitted within the countersunk surface 124 of the control housing 22 or adhesively secured in position. The cover plate has a flat lower surface 131 and an opposite flat upper surface 132. The cover plate has a peripheral edge 133 which is concentric to the axis of rotation 68 with the exception of a recess 134 corresponding to the protrusion 120. A countersunk surface 135 extends about the peripheral edge 133 and recess 134 conforming to the countersunk surface 124. A circular central passage 136 extends through the cover plate concentric to the axis of rotation 68.

A vertical fluid passage 149 interconnects the fluid passage 54 of the drive sleeve 48 and an oblique fluid passage 150, as shown in FIG. 1. An internally screw-threaded passage 151 extends from the oblique fluid passage 150 outwardly through the outer cylindrical surface 80 of the control housing 22. A sprinkler nozzle 152 is screw-threadably received in the screw threaded passage 151. The sprinkler nozzle has a bore 153 through which water under pressure is released in a spray pattern. A control shaft passage 154 interconnects the oblique fluid passage 150 and the lower chamber 107 concentric to the axis of rotation 68 and to the control shaft 65, as shown in FIG. 1. An annulus or seat 155 extends about the control shaft beneath the lower chamber 107 and mounts a fluid seal or O-ring 156 extending about the control shaft in fluid sealing relation.

Thus, it will be seen that the sprinkler 20 is operable to drive the control housing 22 in reciprocal motion about the axis of rotation 68 and, thereby, the sprinkler nozzle 152 through a range of motion varying from substantially three hundred and sixty degrees (360°) about the axis of rotation to substantially any controlled segment thereof. Such motion is imparted to the control housing by the drive mechanism 45 within the drive housing 21 and is transmitted to the control housing through the interconnection of the drive sleeve 48 and the connection sleeve 90. The ribs 57 received in the slots 93 transmit torsional energy to the control housing.

Control of the sector of the three hundred and sixty degrees (360°) of potential reciprocal motion of the control housing by operation of the drive mechanism 45 is controlled by the control shaft 65. The control housing rotates about the axis of rotation 68, as driven by the drive mechanism 45, until predetermined minimum resistance to such motion is applied to the control shaft. The drive mechanism senses this resistance through the control shaft. This sensitivity to resistance to motion is registrable in both directions throughout a range of substantially three hundred and sixty degrees (360°). Upon the sensing of such resistance by the drive mechanism, the drive mechanism operates to reverse motion of the control housing and begin movement thereof in the opposite direction along the path until a similar resistance is sensed by the control shaft in that opposite direction. This process is repeated for as long as the sprinkler is in operation so that, as a result, the sprinkler nozzle 152 is transported in continuous reciprocal motion within the sector defined for the drive mechanism by resistance applied to such motion sensed by the control shaft 65.

Figure 8:
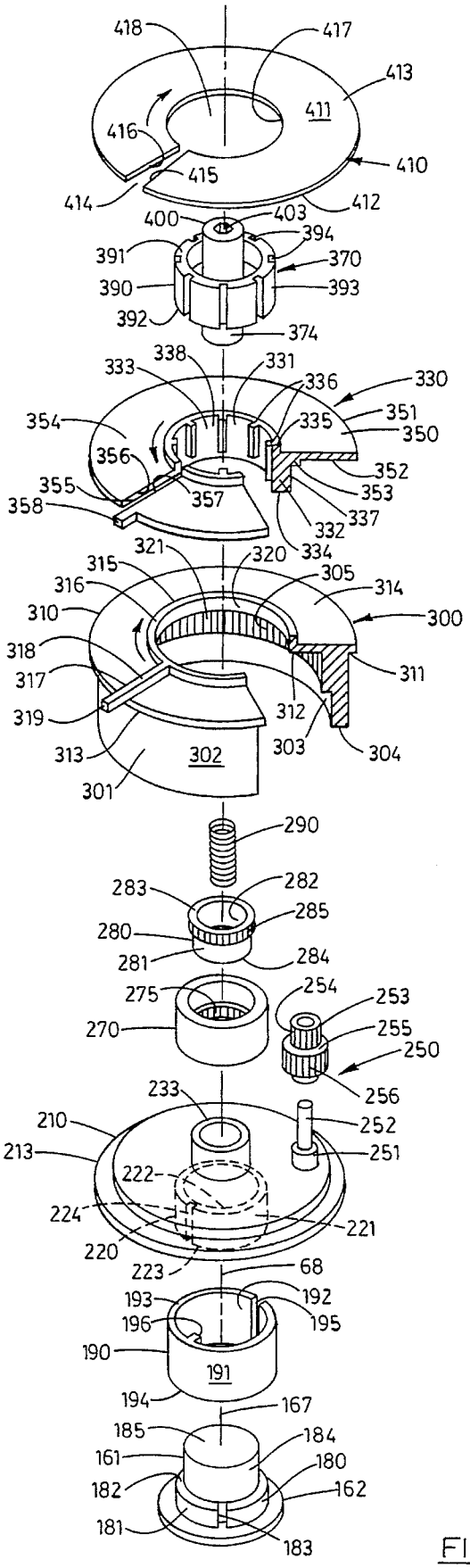
FIG. 8 is a fragmentary, exploded, perspective view of the control apparatus.

Turning then to the control apparatus 10 of the present invention, the internal structure thereof is best visualized upon reference to FIGS. 6 and 8. The control apparatus has a base, or clutch assembly, 160 which has a base member 161. Except as otherwise noted, all portions of the control apparatus are preferably constructed of a suitable molded plastic material. Thus, the base member is also constructed of a suitable molded plastic material. The base member is circumscribed by peripheral flange 162 having a peripheral edge 163 concentric to the axis of rotation 68 of the control shaft 65. The base member has a flat lower surface 164 defining a plane right-angularly related to the axis of rotation 68. The peripheral flange 162 has a flat upper surface 165 right-angularly related to the axis of rotation 68 and concentric thereto. A central passage 166 extends inwardly from the lower surface 164 and is dimensioned to receive the upper portion 67 of the control shaft 65 therewithin, as shown in FIG. 6 in a press fit relationship. The base member 161 is mounted on the upper portion of the control shaft for rotation thereby about the axis of rotation 68 and is retained in the mounted position by this press fit relationship. The base member 161 thereby defines an axis of rotation 167 for the control apparatus which is coincident with the axis of rotation 68 of the control shaft, as shown in FIG. 6.

The clutch assembly 160 has a lower clutch member 180 having a cylindrical surface 181. The lower clutch member has an upper surface 182 right-angularly related to the axis of rotation 167. The lower clutch member has an upper cylindrical surface 184 concentric to the axis of rotation 167. The lower clutch member has a flat upper surface 185 fight-angularly related to the axis of rotation 167.

The clutch assembly 160 includes a clutch sleeve, or ring, 190 best shown in FIG. 8. The clutch ring is of a cylindrical configuration having an outer cylindrical surface 191 and an inner cylindrical surface 192. The clutch ring has an upper edge 193 and an opposite lower edge 194. The clutch ring has a slot 195 extending from the upper edge through the lower edge of the clutch ring parallel to the axis of rotation 167 and, thus, severing the clutch ring so as to form, in effect, a resiliently compressible clip. A ridge, or rib, 196 is mounted on and extends from the inner cylindrical surface 192 parallel to the slot 195 and one hundred and eighty degrees (180°) spaced therefrom about the clutch ring, as shown in FIG. 8. The ridge extends from the upper edge 193 to the lower edge 194.

A base plate 210 has a lower surface 211 in which is formed a circular recess 212, as shown in FIG. 6. The base plate has a circular peripheral edge 213. An upper clutch member 220 is mounted on and extends downwardly from the lower surface 211 of the base plate 210 concentric to the recess 212. The upper clutch member has an outer cylindrical surface 221 which is the same diameter as the cylindrical surface 181 of the lower clutch member 180. The upper clutch member has an inner cylindrical surface 222 which is the same diameter as the upper cylindrical surface 184 of the lower clutch member 180. The upper clutch member has a lower circular annulus 223. A notch, or slot, 224 is formed in the outer cylindrical surface 221 of the upper clutch member and is of the same width and depth as the slot 183 of the lower clutch member. As shown in FIG. 6, the upper cylindrical surface 184 of the lower clutch member is slidably received in the upper clutch member with the slots 183 and 224 disposed in vertical alignment. The clutch ring 190 is extended about the upper and lower clutch members with the ridge 196 received in the aligned slots 183 and 224. The tension of the clutch ring about the upper and lower clutch members retains the ridge in the slots so that the clutch assembly 160, so formed, constitutes a single rotational unit. However, as will be seen, when a rotational force is applied thereto against resistance of the control shaft 65 and drive mechanism 45 about the axis of rotation 167 beyond a predetermined minimum, the force causes the clutch ring to expand sufficiently so that the ridge is released from the slots and, thus, the upper and lower clutch members are rendered rotational relative to each other. However, when the ridge 196 is again aligned with the slots 183 and 224, the ridge is resiliently forced by the clutch ring into the slots thereby again rendering the upper and lower clutch members a single rotational unit.

The base plate 210 has a flat upper surface 230 defining a plane right-angularly related to the axis of rotation 167. The upper surface is circumscribed by a cylindrical surface 231 concentric to the axis of rotation 167. Outwardly of the cylindrical surface 231 is an annular surface 232 circumscribing the cylindrical surface 23 1 and defining a plane right-angularly related to the axis of rotation 167. An upper sleeve 233 is mounted on the upper surface 230 of the base plate concentric to the axis of rotation 167 and having an outer cylindrical surface 234 and an inner cylindrical surface 235. The upper sleeve extends to an annular surface 236 concentric to the axis of rotation 167.

A linking gear assembly 250 is mounted on the upper surface 230 of the base plate 210 on the right, as viewed in FIG. 6. The linking gear assembly includes an upwardly extending base 251 from which is extended a shaft 252 defining an axis of rotation parallel to the axis of rotation 167. A linking gear 253 is rotationally mounted on the shaft 252 for rotation about its axis of rotation. The linking gear has upper gear teeth 254 extending thereabout and thereby forming an upper gear of a predetermined diameter. An annular shoulder 255 extends outwardly therefrom from which is downwardly extended lower gear teeth 256 extending about the linking gear thereby defining a lower gear of a predetermined larger diameter than the upper gear. The relationship of the diameters of the upper and lower gears will hereinafter be described in greater detail.

Referring more particularly to FIGS. 6 and 8, an outer gear ring 270 has an outer cylindrical surface 271 and an opposite inner cylindrical surface 272. The outer gear ring has an upper annulus 273 and an opposite lower annulus 274. The outer gear ring has interior gear teeth 275 extending entirely about the inner cylindrical surface 272 thereof immediately adjacent to the lower annulus 274. An annular lip 276 extends inwardly from the interior gear teeth 275.

An inner gear ring 280 has an outer cylindrical surface 281 and an opposite inner cylindrical surface 282. The inner gear ring has an upper annulus 283 and an opposite lower annulus 284. Exterior gear teeth 285 extend entirely about the outer cylindrical surface 281 of the inner gear ring immediately adjacent to the upper annulus 283 thereof. The inner gear ring is mounted, such as by a suitable adhesive, on and extending about the outer cylindrical surface 234 of the upper sleeve 233. Thus, the inner cylindrical surface 282 is adhesively bonded to the outer cylindrical surface 234 of the upper sleeve, as shown in FIG. 6. The relationship of the inner gear ring to the outer gear ring 270 as shown in FIG. 6 will hereinafter be described in greater detail. A compression spring 290 is received within the upper sleeve 233 and its relationship to the other portions of the control apparatus will also be described hereafter.

The control apparatus 10 has a first adjustment housing 300 which can best be visualized as shown fragmentarily in FIG. 8. The first adjustment housing has a cylindrical wall 301 which, when assembled, as hereinafter described, is concentric to the axis of rotation 167. The cylindrical wall has an outer cylindrical surface 302 and an opposite inner cylindrical surface 303. The cylindrical wall has a lower annular surface 304. Interior gear teeth 305 are mounted on and extend entirely about the inner cylindrical surface 303 of the cylindrical wall in spaced relation to the lower annular surface 304, as shown in FIG. 8.

The first adjustment housing 300 mounts an upper platform 310 integral therewith immediately above the interior gear teeth 305. The upper platform has an outer lower surface, or lip, 311 and an inner lower surface 312. The outer and inner lower surfaces define a plane which, in the assembled configuration, is disposed in right angular relation to the axis of rotation 167. The upper platform is circumscribed by a peripheral edge 313 and has an upper surface 314 defining a plane which, in the assembled configuration, is right-angularly related to the axis of rotation 167. An annular ridge 315 extends upwardly from the upper surface 314 to an upper surface 316 thereof also defining a plane which, in the assembled configuration, is right-angularly related to the axis of rotation 167. A radial ridge 317 is mounted on the upper surface 314 of the upper platform and extends from the annular ridge radially outwardly, as best shown in FIG. 8. The radial ridge has an upper surface 3 18 disposed in the same plane as that defined by the upper surface 316 of the annular ridge 315. The radial ridge extends outwardly beyond the peripheral edge 313 of the upper platform so as to form a control tab or finger 319. The annular ridge 3 15 has an inner cylindrical surface 320 defining an opening 321 extending through the upper platform which, in the assembled configuration, are concentric to the axis of rotation 167.

The control apparatus 10 has a second adjustment housing 330 which can best be visualized as fragmentarily shown in FIG. 8. The second adjustment housing has a cylindrical wall 331 which, in the assembled configuration, is concentric to the axis of rotation 167. The cylindrical wall has an outer cylindrical surface 332 and an opposite inner cylindrical surface 333. The cylindrical wall has a lower annular surface 334 and an upper annular surface 335. A plurality of splines or ribs 336 are mounted on and extend inwardly from the inner cylindrical surface 333 in predetermined spaced relation to each other and having longitudinal axes which are, in the assembled configuration, parallel to the axis of rotation 167. Exterior gear teeth 337 are mounted on and extend entirely about the outer cylindrical surface 332 of the cylindrical wall. The inner cylindrical surface 333 defines a passage 338 which, in the assembled configuration, is concentric to the axis of rotation 167.

The second adjustment housing 330 mounts a lateral plate 350 extending entirely about the cylindrical wall 331 adjacent to the upper annular surface 335. The lateral plate is circumscribed by a peripheral edge 351 which, in the assembled configuration, is concentric to the axis of rotation 167. The lateral plate has a lower surface 352. A shoulder 353 is mounted on and extended from the lower surface 352 extending entirely about the cylindrical wall immediately above the exterior gear teeth 337. The lateral plate has an upper surface 354 defining a plane right-angularly related to the axis of rotation 167 in the assembled configuration. A slot 355 is formed in and extends radially outwardly from the passage 338, through the upper annular surface 335 and through the peripheral edge 351 of the lateral plate. The slot, so formed, is bounded by a right lateral edge 356 and an opposite left lateral edge 357. The lateral plate immediately adjacent to the left lateral edge 357 extends outwardly beyond the peripheral edge 351 of the lateral plate so as to form a control tab, or finger, 358.

The control apparatus 10 has an adjustment wheel 370 best shown in FIG. 8. The adjustment wheel has a central plate 371 having an upper surface 372 and an opposite lower surface 373. A lower sleeve 374 is mounted on and extends downwardly from the lower surface 373 and, in the assembled configuration, is concentric to the axis of rotation 167. The lower sleeve has an outer cylindrical surface 375 and an opposite inner cylindrical surface 376. The lower sleeve extends to a lower annulus 377 which defines a plane which, in the assembled configuration, is right-angularly related to the axis of rotation 167.

The central plate 371 of the adjustment wheel has an outer cylindrical body 390 mounted thereon and having an upper annulus 391 and a lower annulus 392. The outer cylindrical body has an outer cylindrical surface 393 in which a plurality of slots 394 are formed in spaced relation to each other. The outer cylindrical surface 393, in the assembled configuration is concentric to the axis of rotation 167. The slots 394 are positioned and dimensioned individually slidably to receive the ribs 336. Thus, the adjustment wheel is slidable along the ribs and, thus, through the passage 338 of the second adjustment housing along the axis of rotation in the assembled configuration.

The adjustment wheel 370 has an upper sleeve 400 mounted on and extending upwardly from the upper surface 372 of the central plate 371 thereof, as best shown in FIG. 6. The upper sleeve has an outer cylindrical surface 401 which is concentric to the axis of rotation 167 in the assembled configuration. The upper sleeve has an upper surface 402 which, in the assembled configuration, is right-angularly related to the axis of rotation 167. A hexagonal passage 403 extends inwardly of the upper sleeve from the upper surface 402 and is bounded by a surface 404 defining the hexagonal passage. As shown in FIG. 1, a fluid seal, or O-ring, 405 extends about the outer cylindrical surface 401 of the upper sleeve 400 in the assembled configuration.

Figure 7:
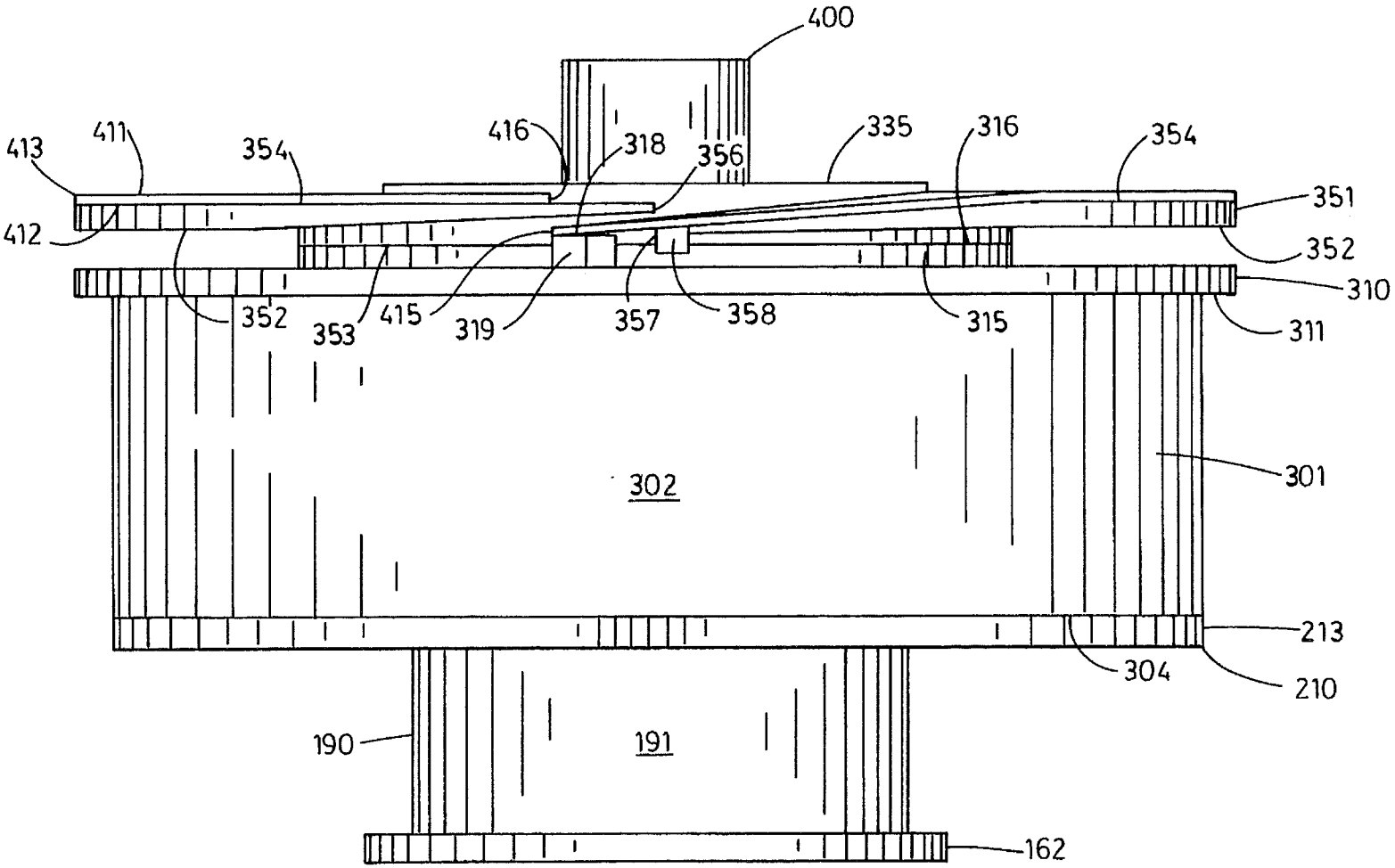
FIG. 7 is a somewhat enlarged side elevation of the control apparatus taken from the same position shown in FIG. 5.

The control apparatus 10 has an indicator plate 410, best shown in FIG. 8, which is also preferably, although not necessarily, constructed of plastic. The indicator plate has a flat upper surface 411 and an opposite flat lower surface 412. The indicator plate is circumscribed by a peripheral edge 413 which, in the assembled configuration, is concentric to the axis of rotation 167. The indicator plate is severed radially to form a slot, or opening, 414 bounded by a fight edge 415 and a left edge 416. The right edge 415 is mounted, such as by a suitable adhesive on the upper surface 318 of the radial ridge 317. As can best be visualized in FIG. 7, in the assembled configuration, the indicator plate has a slight helical configuration and extends from the radial ridge 3 17, through the slot 355 in the lateral plate 350 of the second adjustment housing 330 and overlays the upper surface 354 of the second adjustment housing. Thus, the first adjustment housing 300, the indicator plate 410 and the second adjustment housing 330 are interlaced in the assembled configuration as best shown in FIG. 7. The indicator plate has a circular interior edge 417 bounding a central passage 418. As shown in FIG. 3, the upper surface 411 of the indicator plate has indicia 419 printed, or otherwise formed thereon, for purposes hereinafter described. This indicia preferably includes the upper surface of the indicator plate being color coded as, for example, blue. The upper surface of the second adjustment housing is preferably a contrasting color, such as black or white.

The assembled relationship of the various components of the control apparatus 10 can best be visualized upon reference to FIGS. 6 and 8. The assembled relationship of the clutch assembly 160 has already been described as has the assembled relationship of the linking gear assembly 250. Thus, in summary, the clutch assembly constitutes a single rotational unit with the base plate 210. The linking gear 253 is rotationally mounted on the shaft 252. Similarly, the inner gear ring 280 has already been described as mounted adhesively on the outer cylindrical surface 234 of the upper sleeve 233 as shown in FIG. 6.

In their assembled relationship, the remainder of the components of the control apparatus 10 are as follows. The outer gear ring 270 is mounted by any suitable means, such as adhesively, with the upper annulus 273 thereof in facing engagement with the lower annular surface 379 of the adjustment wheel 370 and with the inner cylindrical surface 272 mounted in facing engagement with the lower cylindrical surface 378 of the adjustment wheel also as shown in FIG. 6. The outer gear ring is positioned on the inner gear ring 280 with the interior gear teeth 275 of the outer gear ring in engagement with the exterior gear teeth 285 of the inner gear ring and the lip 276 of the outer gear ring engaging the bottom of the exterior gear teeth 285 to prevent upward movement of the outer gear ring from the position shown in FIG. 6. Simultaneously, the lower sleeve 374 is slidably received in the upper sleeve 233 of the base plate 210 with the compression spring 290 captured within the lower sleeve 374, as shown in FIG. 6.

The assembly of the first adjustment housing 300, the second adjustment housing 330 and the indicator plate 410 relative to each other has already been described. This subassembly is slidably received about the adjustment wheel 370 with the ribs 336 of the second adjustment housing individually slidably received in the slots 394 of the adjustment wheel. The subassembly of the first adjustment housing, second adjustment housing and indicator plate 410 are moved to the position shown in FIG. 6 wherein the exterior gear teeth 337 of the second adjustment housing are engaged in the upper gear teeth 254 of the linking gear 253. Similarly, the interior gear teeth 305 of the first adjustment housing 300 are received in the lower gear teeth 256 of the linking gear 253. The gear ratios are such that when one of the adjustment housings is moved in one direction about the axis of rotation 167, the other adjustment housing is moved in the opposite direction about the axis of rotation substantially the same distance.

In the described assembled relationship, the engagement of the interior gear teeth 275 of the outer gear ring in the exterior gear teeth 285 of the inner gear ring 280, as well as the engagement of the interior gear teeth 305 and exterior gear teeth 337, respectively, of the first and second adjustment housings with their respective lower gear teeth 256 and upper gear teeth 254 of the linking gear 253, prevent rotation of the subassembly, comprised of the first and second adjustment housings and the indicator plate, relative to the axis of rotation 167. Thus, as shown in the assembled relationship shown in FIG. 6, the entire control apparatus 10 is locked in the position shown with respect to its internal working parts with the sole exception that the adjustment wheel 370 is slidable against pressure of the compression spring 290 downwardly as shown in FIG. 6. Such slidable movement is permitted by the engagement of the ribs 336 in the slots 394 and the interior gear teeth 275 of the outer gear ring 270 in the exterior gear teeth 285 of the inner gear ring 280.

OPERATION

The operation of the described embodiment of the subject invention is believed to be clearly apparent and is briefly summarized at this point.

Referring first to FIG. 1, the control apparatus 10 is installed in the sprinkler 20, with the transparent cover plate 130 removed, by positioning the control apparatus in the upper chamber 103 with the clutch assembly 160 received in the lower chamber 107 and the upper portion 67 of the control shaft 65 press fitted or otherwise mounted within the central passage 166 of the clutch assembly as shown in FIGS. 1 and 6. The transparent cover plate 130 is then installed in the position shown in the countersunk surface 135 with the upper sleeve 400 of the adjustment wheel 370 and the O-ring 405 thereof received in the central passage 136 of the transparent cover plate as shown in FIG. 1. As previously noted, the transparent cover plate can either be press fit into the described installed position or adhesively secured in the position described. The resulting assembled sprinkler 20, containing the control apparatus 10, is thus fully operational once installed. When installed, the sprinkler is connected to a source of water under pressure, not shown, controlled through a valve or irrigation system, not shown. In this assembled operational relationship, the control apparatus is fully rotational with the control shaft 65. The control apparatus is sealed from the environment by the transparent cover plate 130 and the O-ring 405, but is fully operable for the performance of its various operational objectives, as hereinafter described.

The sprinkler 20 operates in the normal fashion with the control apparatus 10 set at a particular setting. Water under pressure passes along the fluid passage 55, from the source of fluid under pressure, in a direction indicated by arrows 56 about the drive mechanism 45 through the fluid ports 52 of the drive sleeve 48, up the fluid passage 54 of the drive sleeve, through the vertical and oblique fluid passages 149 and 150 and is discharged in a spray pattern through the bore 153 of the sprinkler nozzle 152. The adjustment screw 123 can be adjusted to or from the bore so as to adjust the pattern as it is released from the bore. The O-ring 156 prevents water from entering the upper and lower chambers 103 and 107, respectively.

During such operation, the drive mechanism 45 causes the control housing 22 to be reciprocated by means of such reciprocal movement of the drive sleeve 48 in interconnection with the connection sleeve 90 of the control housing 22. The control housing and its sprinkler nozzle 152 are, in effect, rotated about the control shaft 65 and the control apparatus 10 which, in effect, remains stationary.

Referring more particularly to FIG. 3, as hereinafter described, the portion of the three hundred and sixty degrees (360°) of possible movement of the control housing 22 in the path of travel by the drive mechanism 45 is controlled by engagement of the control fingers 319 and 358 of the control apparatus with the rounded surface 121 of the protrusion 120. The resistance imparted to the control shaft 65 when a control finger engages the rounded surface 121 is transferred through the control shaft 65 to operate the drive mechanism. This particular part of the operation is conventional, as previously mentioned, and as described, for example, in the Bruninga U.S. Pat. No. 4,892,252. Thus, for example, when control finger 319 engages the rounded surface 121 of the protrusion 120 as shown in FIG. 3 by rotation of the control housing in a counterclockwise direction as viewed in FIG. 3, the resistance is imparted to the drive mechanism which then causes the control housing to be rotated by the drive mechanism in the opposite, or clockwise direction, as viewed in FIG. 3. Such movement of the control housing in this new, clockwise direction is continued until the control finger 358 is contacted by the rounded surface 121 of the protrusion 120 thus having completed roughly three hundred and fifty degrees (350°) of rotation about the axis of rotation 167 with the setting shown in FIG. 3 by way of example. The control housing is then, again, rotated in the reverse or counterclockwise direction. This reciprocal movement of the control housing is continued by the drive mechanism for as long as the sprinkler is in operation.

If the control apparatus 10 has a setting for the control fingers 319 and 358 which is as desired, the control apparatus will continue to operate in the manner previously described with no other service or adjustment. Throughout the operation thereof, and at any time when the sprinkler 20 is not in operation, the control apparatus is fully visible through the transparent cover plate 150 to indicate immediately to any observer what the range of movement to which the sprinkler has been set. The indicia 419 printed, or otherwise formed, on the upper surface 411 of the indicator plate 410 served to immediately indicate this fact. However, preferably, as previously noted, the upper surface of the indicator plate has a color, such as blue, contrasting with the underlying color, such as black or white, of the upper surface 354 of the lateral plate 350 of the second adjustment housing 330. Thus, as visualized in FIG. 3, the upper surface 411 of the indicator plate 410 is blue from the control finger 319 in a clockwise direction completely thereabout to the control finger 358 thus designating approximately a setting of three hundred and fifty degrees (350°). In contrast, the upper surface 354 between the control fingers 319 and 358 representing approximately ten degrees (10°) is white. Thus, any person observing the upwardly disposed face of the control apparatus through the transparent cover plate 130, is immediately advised that the sprinkler is set to move in a path of approximately three hundred and fifty degrees (350°) and the direction of the sector.

The control apparatus 10 is at this time essentially tamper proof in that the only access to the control apparatus is by inserting an object in the hexagonal passage 403 of the upper sleeve 400. Any attempt to rotate the control apparatus in either direction will be resisted by the engagement of the internal gears of the control apparatus as well as by the control shaft 65. However, if greater than a predetermined minimum of rotational force is applied in this fashion, the clutch assembly 160 previously described operates to cause the clutch ring 190 to release the ridge 196 thereof from the slots 183 and 224 thereby allowing the control apparatus to be rotated about the upper cylindrical surface 184 of the lower clutch member 180 without any damage to the control apparatus, control shaft or drive mechanism 45. At the same time, the selected adjustment of the control apparatus is not changed from the setting due to the interlocking of the internal gears thereof previously described. However, the clutch assembly will again engage in the locked position when service personnel, using the hexagonal passage with a suitable hexagonal tool, rotate the control apparatus until the slots 183 and 224 are again aligned and the ridge 196 of the clutch ring 190 is resiliently forced by the clutch ring into the slots. If service personnel do not reset the clutch assembly, it will automatically reset itself when the sprinkler is again activated, or during continued operation thereof. Thus, the normal operating relationship is reestablished interlocking the upper clutch member 220 and lower clutch member 180 for rotational movement as a unit. When the sprinkler 20 is again activated, the original existing setting of the control apparatus has not been changed even though subjected to the tampering effort. Thus, the sprinkler remains fully functional in the precise setting desired not withstanding the effort at tampering.

When authorized personnel wish to readjust the setting of the control apparatus 10 for the sprinkler 20, either at the time of installation or at anytime throughout the life of the sprinkler, such readjustment is readily achieved. A suitable hexagonal tool is inserted in the hexagonal passage 403 and pressure is exerted downwardly against action of the compression spring 290 to cause the adjustment wheel 370 to be moved downwardly along the axis of rotation 167. Such downward movement is permitted by movement of the ribs 336 within the slots 394 of the adjustment wheel. Such downward movement causes the interior gear teeth 275 of the outer gear ring 270 to move downwardly in their engagement with the exterior gear teeth 285 of the inner gear ring 280. Such movement is continued until the interior gear teeth move downwardly sufficiently and thereby out of engagement with the exterior gear teeth 285. Once this position is reached with the adjustment wheel, the adjustment wheel is free to be rotated about the axis of rotation 167. Such rotation transmits rotational energy through the engagement of the ribs 336 and the slots 394. Thus, the rotational energy is transmitted to the second adjustment housing 330.

Figure 2:
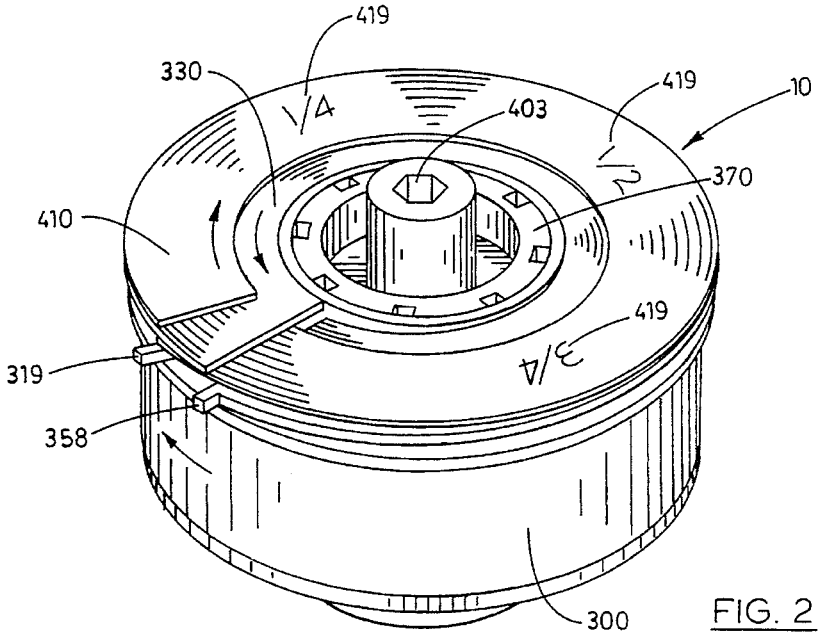
FIG. 2 is a somewhat enlarged perspective view of the control apparatus of the present invention.
Figure 5:
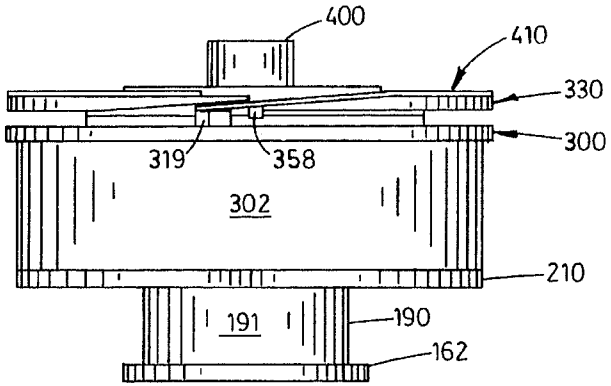
FIG. 5 is a side elevation of the control apparatus showing the control fingers thereof.
Figure 4:
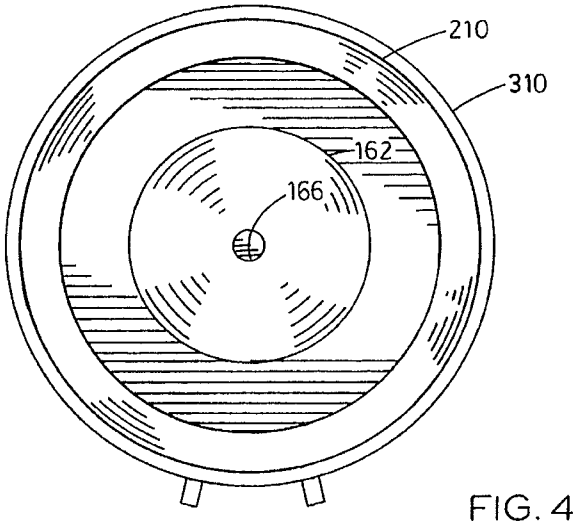
FIG. 4 is a bottom plan view of the control apparatus.

Through engagement of the exterior gear teeth 337 of the second adjustment housing 330 with the upper gear teeth 254 of the linking gear 253 causes the linking gear 253 to be rotated about the shaft 252. Such rotation of the linking gear causes rotational energy to be transmitted by the lower gear teeth 256 to the interior gear teeth 305 of the first adjustment housing 300. Thus, as illustrated by the arrows in FIGS. 2 and 8, the first and second adjustment housings are rotated in opposite directions to each other. At the same time and at the same rate, the indicator plate 410 is rotated in the same direction as the first adjustment housing 300.

In the manner previously described, such movement causes the control fingers 319 and 358 to be moved toward each other or from each other depending upon the direction of movement of the upper sleeve 400 as desired by the operator. Similarly, the indicator plate 410 evidences precisely in the manner described the setting to which the control fingers are moved relative to each other and thereby the arc or portion of the three hundred and sixty degrees (360°) to which the path of movement of the sprinkler is adjusted. The range of setting possible by such adjustment is substantially any desired sector of the three hundred and sixty degree (360°) range.

Once the desired setting has been achieved in the manner described, the control apparatus 10 is left in the desired setting simply by removing the tool from the hexagonal passage 403 to allow the compression spring 290 to return the adjustment wheel 370 to the fully extended position as shown in FIG. 6. The compression spring thus automatically reengages the interior gear teeth 275 and exterior gear teeth 285 of the respective outer and inner gear rings 270 and 280, respectively, thereby again locking the control apparatus with a new setting. No other adjustment is required for operation in the manner previously described until resetting of the control apparatus is again desired.

If desired, the control housing 22 can be manufactured with the transparent cover plate 130 pressure fitted or otherwise fastened in position other than permanently. Where this is done, it permits the control apparatus to be removed and replaced should it require such replacement at anytime. Conversely, the manufacturer may prefer adhesively to mount the transparent cover plate in position so as completely to seal the unit against fouling by deleterious material or tampering as a result of removal of the transparent cover plate.

Therefore, the control apparatus of the present invention is adapted to control the path of movement of a work object;

is capable of reliably setting the path of movement of the work object for operation over a long operational period; virtually eliminates the risk of misadjustment as a result of tampering or inadvertent missetting thereof; affords an immediately recognizable and precise display of the range of movement to which it has been set so as to avoid inadvertent misadjustment; possesses a simplicity of structure and operation ensuring a long operational life and a minimum purchase price; and otherwise is entirely effective in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described our invention, what we claim as new and desire to secure by Letters Patent is:

1. A control apparatus for a work object comprising a pair of members operably interconnected for rotation about a substantially common axis of rotation; gear means interconnecting said members for transmitting rotational movement about said axis of rotation between said members whereby when one of the members of said pair of members is rotated in one direction substantially about said axis of rotation, the other member of said pair of members is rotated by said gear means in the opposite direction substantially about said axis of rotation substantially the same distance to define a selected relationship; and means for mounting said members in visibly exposed relation on and in controlling relation to said work object whereby said selected relationship is operable to control said work object and is visible to display said selected relationship.

2. The control apparatus of claim 1 wherein said gear means includes gear races individually borne by said members and a linking gear individually engaging said gear races for the transmission of said rotational movement between the members of said pair of members.

3. The control apparatus of claim 2 wherein said gear races are substantially concentric to said axis of rotation and the linking gear is mounted for rotation substantially about a second axis of rotation eccentric to said first axis of rotation.

4. The control apparatus of claim 1 including locking means substantially preventing rotation of said pair of members until said locking means has been deployed in a predetermined attitude.

5. The control apparatus of claim 1 including indicator means mounted on one of said members in said visibly exposed relation and disposed to display said selected relationship defined by the members.

6. A control apparatus for a work object, the control apparatus comprising a pair of substantially contrarotating members operably interconnected in a substantially contrarotating relationship about a substantially common axis of rotation to define a selected relationship; gear means operably interconnecting said members for transmitting rotational movement between said members whereby when one of the members of said pair of members is rotated in one direction substantially about said axis of rotation, the other member of said pair of members is rotated by said gear means in the opposite direction substantially about said axis of rotation substantially the same distance; means for mounting said substantially contrarotating members in controlling relation to said work object whereby said selected relationship is operable to control said work object; and locking means substantially preventing said substantially contrarotation of the pair of members until said locking means has been deployed in a predetermined attitude.

7. The control apparatus of claim 6 wherein said locking means includes a mount for mounting one of the members of said pair of members in substantially fixed relation to the work object and a locking member engageable with the other member of said pair of members and moveable between a locking position, in substantially fixed relation to said mount so that the pair of members cannot be moved in said substantially contrarotating relationship, and a release position, in which the locking member is free to move about said axis of rotation and thereby move the members of said pair of members in said substantially contrarotating relation.

8. The control apparatus of claim 7 including an assembly operably interconnecting said mount and the pair of members operable to release to permit rotational movement of the pair of members substantially about said axis of rotation when a predetermined minimum amount of force is applied to the locking member about said axis of rotation.

9. The control apparatus of claim 8 including engagement means operably interconnecting the locking member and said mount in said locking position substantially to prevent movement by the locking member about the axis of rotation and operably disengaging the locking member and the mount in said release position to permit movement about said axis of rotation.

10. The control apparatus of claim 9 wherein said engagement means mounts the locking member for movement between the locking position and the release position substantially along the axis of rotation.

11. A control apparatus for a work object, the control apparatus comprising a pair of substantially contrarotating members operably interconnected in a substantially contrarotating relationship about a substantially common axis of rotation to define a selected relationship; gear means operably interconnecting said members for transmitting rotational movement between said members whereby when one of the members of said pair of members is rotated in one direction substantially about said axis of rotation, the other member of said pair of members is rotated by said gear means in the opposite direction substantially about said axis of rotation substantially the same distance; means for mounting said substantially contrarotating members in controlling relation to said work object whereby said selected relationship is operable to control said work object; and indicator means mounted on one of said substantially contrarotating members and disposed to display said selected relationship during said movement of the substantially contrarotating members.

12. The control apparatus of claim 11 wherein said pair of substantially contrarotating members individually have substantially parallel surfaces disposed in substantially radially extending relation, substantially parallel to said axis of rotation, said surface of one of said substantially contrarotating members has a substantially radially extending slot therein and said indicator means includes an indicator plate mounted on the substantially contrarotating member not having said slot, extending through said slot of the other of said substantially contrarotating members and overlaying the surface thereof substantially concentric to said axis of rotation whereby said substantially contrarotating movement about said axis of rotation displays said selected relationship.

13. The control apparatus of claim 12 wherein the indicator plate and the surface of the member of said pair of substantially contrarotating members having the slot have distinctive indicia thereon more visibly to display said selected relationship.

* * * * *